US008006336B1

(12) United States Patent
Gerlach et al.

(10) Patent No.: US 8,006,336 B1
(45) Date of Patent: Aug. 30, 2011

(54) FABRIC ARTICLE TREATING METHOD AND APPARATUS

(75) Inventors: Christian Gerhard Friedrich Gerlach, Brussels (BE); Bradford Scott Barron, Cincinnati, OH (US); Dean Larry DuVal, Lebanon, OH (US); Chandrika Kasturi, Cincinnati, OH (US); John Habib Nackhla, Cincinnati, OH (US); Robert Henry Rohrbaugh, Hamilton, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 1107 days.

(21) Appl. No.: 10/613,615

(22) Filed: Jul. 3, 2003

Related U.S. Application Data

(63) Continuation-in-part of application No. 10/321,745, filed on Dec. 17, 2002, now abandoned.

(60) Provisional application No. 60/342,725, filed on Dec. 20, 2001.

(51) Int. Cl.
*D06F 35/00* (2006.01)

(52) U.S. Cl. ..... 8/158; 68/5 R; 68/5 C

(58) Field of Classification Search ..... 68/137, 68/138, 150, 102, 242, 12.26, 222, 5, 102.3; 8/148, 149.2, 149.3, 158
See application file for complete search history.

(56) References Cited

U.S. PATENT DOCUMENTS

| | | | | |
|---|---|---|---|---|
| 3,385,713 | A * | 5/1968 | Levinson et al. | 426/538 |
| 3,401,852 | A * | 9/1968 | Gruver | 223/69 |
| 3,470,716 | A * | 10/1969 | Candor et al. | 68/4 |
| 3,696,043 | A | 10/1972 | LaBarge et al. | |
| 3,718,609 | A | 2/1973 | Weimer | |
| 3,961,878 | A * | 6/1976 | Capponi et al. | 8/444 |
| 4,164,306 | A | 8/1979 | Perrin | |
| 4,341,347 | A * | 7/1982 | DeVittorio | 239/3 |
| 4,765,515 | A | 8/1988 | Lippman | |
| 5,038,812 | A | 8/1991 | Norman | |
| 5,141,120 | A | 8/1992 | Brown et al. | |
| 5,328,055 | A | 7/1994 | Battle | |
| 5,358,147 | A | 10/1994 | Adams et al. | |
| 5,509,578 | A | 4/1996 | Livingstone | |
| 5,527,564 | A | 6/1996 | Napadow et al. | |
| 5,555,641 | A * | 9/1996 | Lee | 34/261 |
| 5,630,847 | A | 5/1997 | Roetker | |
| 5,789,368 | A | 8/1998 | You et al. | |
| 5,791,525 | A | 8/1998 | Fan | |
| 5,815,961 | A * | 10/1998 | Estes et al. | 38/14 |
| 5,992,698 | A | 11/1999 | Copeland et al. | |
| 6,159,928 | A * | 12/2000 | Mayahara et al. | 512/26 |
| 6,189,346 | B1 | 2/2001 | Chen et al. | |
| 6,387,081 | B1 | 5/2002 | Cooper | |
| 6,474,563 | B2 * | 11/2002 | Pletcher et al. | 239/3 |
| 6,521,584 | B1 | 2/2003 | Soldanski et al. | |

(Continued)

FOREIGN PATENT DOCUMENTS

EP 1 215 330 A 6/2002

(Continued)

*Primary Examiner* — Michael Barr
*Assistant Examiner* — David Cormier
(74) *Attorney, Agent, or Firm* — Marianne Dressman; Leonard W. Lewis

(57) ABSTRACT

An in-home method for treating a fabric article in need of treatment and a new to the world, in-home, self-contained, stand alone fabric article treating apparatus, such as a "cabinet"-type of apparatus, useful in such method is provided.

1 Claim, 8 Drawing Sheets

U.S. PATENT DOCUMENTS

| | | | | |
|---|---|---|---|---|
| 6,840,068 | B2 * | 1/2005 | Pasin et al. | 68/5 C |
| 7,059,065 | B2 * | 6/2006 | Gerlach et al. | 34/381 |
| 7,146,749 | B2 * | 12/2006 | Barron et al. | 34/596 |
| 7,392,600 | B2 * | 7/2008 | Gerlach et al. | 34/381 |
| 2002/0069465 | A1 * | 6/2002 | Chute et al. | 8/158 |

FOREIGN PATENT DOCUMENTS

| | | | |
|---|---|---|---|
| EP | 1 215 330 | A1 | 6/2002 |
| WO | WO 01/89708 | A | 11/2001 |
| WO | WO 01/89708 | A2 | 11/2001 |
| WO | WO 03/029551 | A | 4/2003 |

* cited by examiner

FABRIC ARTICLE TREATING METHOD AND APPARATUS

RELATED APPLICATIONS

This application is a continuation-in-part of U.S. Ser. No. 10/321,745 filed Dec. 17, 2002 now abandoned which claims the benefit of U.S. Provisional Application Ser. No. 60/342,725 filed Dec. 20, 2001.

FIELD OF THE INVENTION

The present invention relates to an in-home method for treating a fabric article in need of treatment and a new to the world, in-home, self-contained, stand alone fabric article treating apparatus, such as a "cabinet"-type of apparatus, useful in such method. More particularly, the present invention relates to an in-home method for treating a fabric article that employs an electrically charged liquid to drive deposition of the liquid onto the fabric article to be treated.

The electrically charged liquid may also be used to drive deposition of the liquid onto the fabric article treating apparatus.

BACKGROUND OF THE INVENTION

Fabric article treating methods and/or apparatuses have been evolving recently. For example, U.S. Pat. Nos. 5,815,961 and 6,189,346, describe a fabric article treating apparatus, in the form of a cabinet, and method for subjecting fabric article items to moisture, pressure and heat for refreshing and dewrinkling the garment items. A fabric article is hung in the cabinet by a hangar system and placed under tension. The fabric article is then subjected to moist air (i.e., steam) or mist (i.e., small water droplets) containing chemistries that enhance the removal of wrinkles. As a final step, the fabric article is subjected to heated air to dry the garment. Due to the configuration of the fabric article in the cabinet, deposition of the steam and/or mist is not optimized.

Similarly, PCT Publication WO 00/75413 describes an apparatus for treating a fabric article which includes a collapsible or expandable container. A fabric article is hung in the container and then subjected to a fabric treating composition, such as steam or other fabric article treating actives. However, like the cabinet described above, deposition of the fabric treating composition onto the clothes item is not optimized.

There exists an on-going need to develop a fabric article treating method and/or apparatus, especially an in-home fabric article treating method and/or apparatus that improves the deposition of fabric article actives as compared to the currently existing deposition methods and/or apparatuses.

SUMMARY OF THE INVENTION

The needs in the art identified above are met by the present invention which provides an in-home method for treating a fabric article in need of treatment and a new to the world, in-home, self-contained, stand alone fabric article treating apparatus for use within the method.

In one aspect of the present invention, an in-home method for treating a fabric article in need of treatment comprising:

a. providing a new to the world, in-home, self-contained, stand alone fabric article treating apparatus designed for domestic use, wherein the apparatus comprises 1) a housing which defines a fabric article receiving volume, 2) a fabric article fixturing system which immobilizes and tensions the article, and 3) a source of an electrically charged liquid, and optionally, 4) a safety system capable of preventing contact of the electrically charged liquid to a user of the fabric article treating apparatus;

b. positioning the fabric article in need of treatment within the fabric article receiving volume by associating the fabric article with the fabric article fixturing system;

c. operating the fabric article treating apparatus such that the source of the electrically charged liquid delivers the electrically charged liquid to the fabric article positioned within the fabric article receiving volume such that the fabric article is treated, is provided.

In another aspect of the present invention, a new to the world, in-home, self-contained, stand alone fabric article treating apparatus for treating a fabric article in need of treatment comprising:

a. a housing which defines a fabric article receiving volume;

b. a fabric article fixturing system which immobilizes and tensions the article; and c. a source of an electrically charged liquid; and d. optionally, a safety system capable of preventing contact of the electrically charged liquid to a user of the fabric article treating apparatus, is provided.

In yet a further aspect of the present invention, the source of the electrically charged fabric article treating apparatus comprises:

a. a material made of conductive material;

b. a collapsible bag in solid communication with the electrical source, wherein the bag has at least one contact point through which an electrical charge passes during delivery of the fluid to the fabric article;

c. an electrical charging component for electrically charging the collapsible bag to be electrically charged; and d. a means for grounding the fabric article being treated for the purpose of charge dissipation, said means for grounding comprising: i) a connector in electrical contact with the low level voltage output of the generator and which is maintained at low or zero electrical potential; and ii) a pin or other fastening means in electrical contact with the fabric article and which is capable of being electrically isolated from the connector and from ground, and wherein in use, the connector and fastening means are brought into electrical connection in order to establish a charge-dissipation grounding loop.

Typically, the collapsible bag, is either electrically charged prior to dispensing of the fluid during the dispensing of the fluid, or a combination thereof.

In yet another aspect of the present invention, a fabric article treated by the method of the present invention, is provided.

DETAILED DESCRIPTION OF THE INVENTION

Definitions

Figure 1:
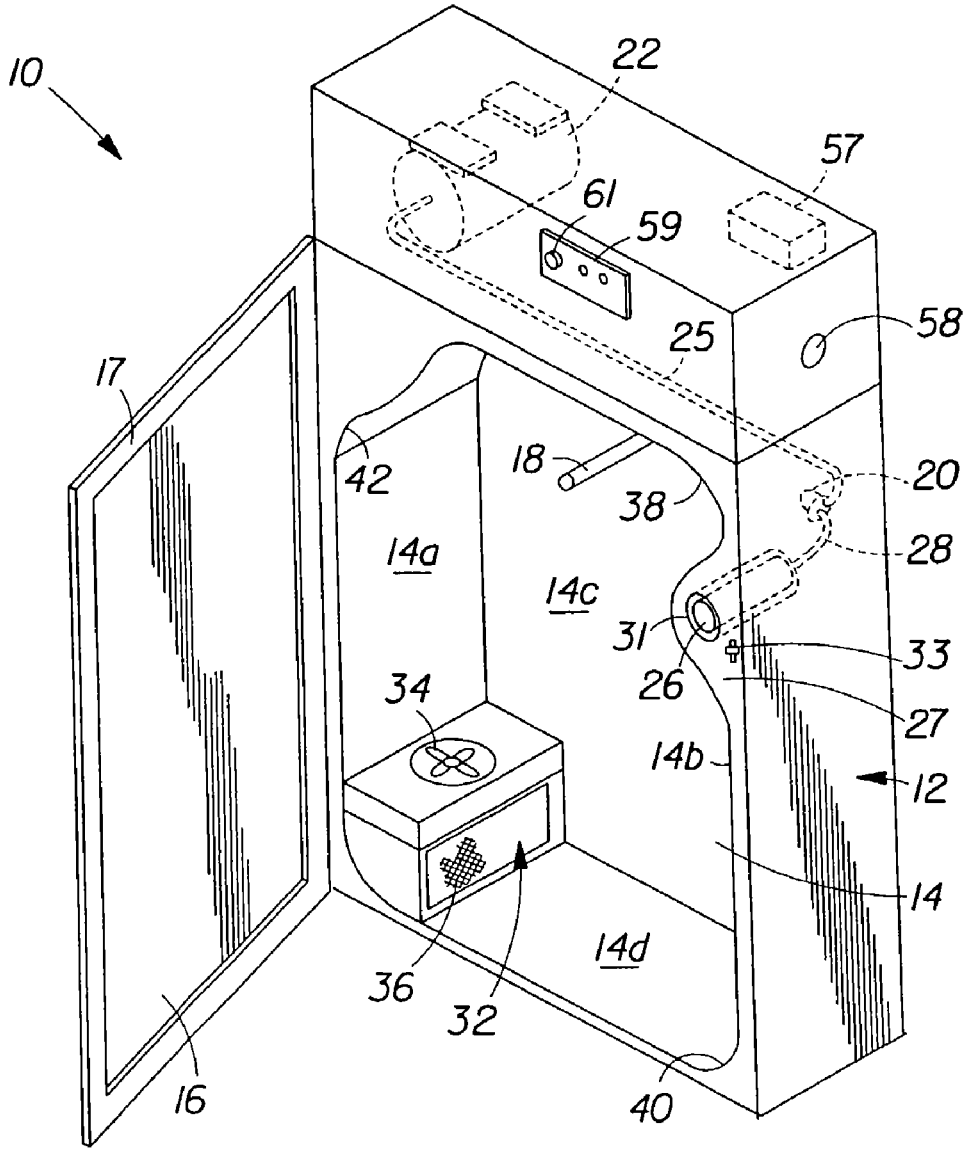
FIG. 1 is a top, front perspective view of one embodiment of a fabric article treating cabinet apparatus in accordance with the present invention with the door open.

The phrase "new to the world, in-home, self-contained, stand alone fabric article treating apparatus" as used herein means an apparatus that is not a conventional automatic clothes dryer, and/or a conventional washing machine, and/or a fabric article pressing device and/or modifications thereof.

"Fabric article" as used herein means any article that is customarily cleaned in a conventional laundry process or in a dry cleaning process. The term encompasses articles of clothing, linen and drapery, clothing accessories, and floor coverings. The term also encompasses other items made in whole or in part of fabric, such as tote bags, furniture covers, tarpaulins and the like.

"Fabric article fixturing system" as used herein means any structure associated with the new to the world, in-home, self-contained, stand alone fabric article treating apparatus of the present invention from which a fabric article can be hung and/or draped over and/or tensioned in such a way that the fabric article is immobilized within the apparatus. Examples of such fabric article fixturing systems includes a hanger and/or a rod from which a hanger hangs and/or an inflatable hanger system, such as described in U.S. Pat. No. 5,815,961 to Whirlpool.

"Refreshing" as used herein means cleaning, dewrinkling, and/or deodorizing fabric articles.

Electrically Charged Liquid

"Electrically charged liquid" as used herein means any liquid, typically aqueous liquid, that has an applied potential in the range of from about 0.2 to about 50 kV and/or from about 0.5 to about 30 kV and/or from about 0.5 to about 25 kV. The liquid may be electrically charged at any point in time prior to contacting the fabric article, the fabric article treating apparatus, and/or the fabric article fixturing system. Preferably it is electrically charged at the time it is delivered from the nozzle, but it may be electrically charged after delivery from the nozzle.

"Source of electrically charged liquid" as used herein means any device or component associated with the new to the world, in-home, self-contained, stand alone fabric article treating apparatus that is capable of delivering an electrically charged liquid to a fabric article present in the apparatus, the fabric article treating apparatus, and/or the fabric article fixturing system.

The source comprises an electrical charging component, typically an electrical field, that electrically charges the liquid. The source may also, and typically does, comprise a reservoir for containing the liquid to be electrically charged and/or the electrically charged liquid. In one embodiment, the electrical charging component is integral with the reservoir. In another embodiment, the electrical charging component is separate and discrete from the reservoir.

Further, the source may also, and typically does, comprise a nozzle through which the liquid to be charged or the electrically charged liquid passes during delivery to the fabric article. In one embodiment, the electrical charging component is integral with the nozzle. In another embodiment, the electrical charging component is separate and discrete from the nozzle.

Further yet, the source may comprise an adjusting component capable of controlling the orientation and/or direction of the dispensing electrically charged liquid from the nozzle.

Still further yet, the source may comprise a shaping component capable of electrically shaping the liquid dispensing from the nozzle. The shaping component may comprise an insulating element whereby in use the first droplets to contact the insulating element generate an electrostatic field for shaping the delivery of the electrically charged liquid and/or a conductive element whereby in use the conductive element is charged so as to generate an electrostatic field for shaping the delivery of the electrically charged liquid.

In one embodiment, the source of electrically charged liquid comprises:

a. a reservoir for containing a liquid to be electrically charged;

b. a nozzle in fluid communication with the reservoir, wherein the nozzle has at least one orifice through which an electrically charged liquid passes during delivery to the fabric article;

c. an electrical charging component for electrically charging a liquid to be electrically charged; and d. a means for grounding the fabric article for the purpose of charge dissipation, said means for grounding comprising: i) a connector in electrical contact with the low level voltage output of the generator and which is maintained at low or zero electrical potential; and a pin or other fastening means in electrical contact with the fabric article and which is capable of being electrically isolated from the connector and from ground, and wherein in use, the connector and fastening means are brought into electrical connection in order to establish a charge-dissipation grounding loop.

Typically, the liquid dispensed from the nozzle, either electrically charged prior to dispensing or after and/or both, is delivered to the nozzle by any suitable means, a nonlimiting example of such is hydraulic pressure using a suitable pump, such as a peristaltic pump as non-conductive. Generally, a suitable pump will have an operating pressure in the range of from about 100 to about 2,000 kPas, although lower pressures between 50 and 1500 kPas, and/or from about 140 to about 1050 kPas and/or 100 to 500 kPas can be used.

Generally, the electrically charged liquid is a conductive aqueous liquid. It is desirable that the liquid have a resistivity lower than about $10^4$ ohm cm. However, higher resistivity liquid can also be effectively delivered using the methods and apparatuses of the present invention.

In-Home Fabric Article Treating Apparatus

In one embodiment, the fabric article treating apparatus includes a housing, preferably a rigid housing, more preferably a cabinet, that defines a fabric article receiving volume; a fabric article fixturing system by which the fabric article in need of treatment can be hung, immobilized, and placed under tension; and a source of an electrically charged liquid; and optionally, a safety system capable of preventing contact of the electrically charged liquid to a user of the fabric article treating apparatus.

A nonlimiting example of a preferred cabinet apparatus is described in U.S. Pat. Nos. 5,815,961 and 6,189,346.

In a second embodiment, the fabric article treating apparatus includes a housing, preferably a flexible housing, more preferably a collapsible bag, that defines a fabric article receiving volume; a fabric article fixturing system by which the fabric article in need of treatment can be hung, immobilized, and placed under tension; and a source of an electrically charged liquid; and optionally, a safety system capable of preventing contact of the electrically charged liquid to a user of the fabric article treating apparatus.

A nonlimiting example of a preferred collapsible bag apparatus is described in PCT Publication No. WO 00/75413.

a. Cabinet Apparatus

A fabric article treating apparatus, in accordance with the present invention, includes a cabinet that defines an interior region (a fabric article receiving volume). A fabric article fixturing system in the form of a rod or hook extends from an inner wall of the cabinet for supporting at least one hanger on which a fabric article can be hung within the interior region. A door is movably connected to the cabinet for closing the interior region. A source of an electrically charged liquid in the form of a nozzle, preferably a fluid atomizing nozzle and/or even a simple orifice through which the electrically charged fluid and/or fluid to be electrically charged can pass, is supported by the cabinet and is fluidly connected to a reservoir containing a liquid to be electrically charged. The fluid atomizing nozzle can be operated using compressed air to siphon the liquid from the reservoir and atomize it as it leaves the nozzle. The fluid could also be forced through the atomizing nozzle using a positive displacement liquid pump. A fan is provided for circulating air within the interior region such that the mist form of the electrically charged liquid is distributed more evenly onto the fabric article hanging within the interior region. However, air circulation during spraying is not essential (but possible) when the electrically charged fluid is in the form of large droplets. The trajectory of such electrically charged fluid droplets is determined by electrostatic attraction. Accordingly, the fabric article treating apparatus provides a means for applying an electrically charged liquid onto a fabric article in need of treatment which does not include means for supplying steam into the interior region.

The apparatus preferably further comprises a grounding component, such as a metal hanger and/or metal plate, that is releasably connected to the fixturing system in a fashion such that the fabric article is draped around the grounding component thus facilitating deposition from the nozzle to the fabric article of the electrically charged liquid, and thus any fabric article actives contained in the electrically charged liquid as it passes through and/or deposits onto the fabric article.

Referring to FIG. 1, there is illustrated a fabric article treating apparatus for refreshing fabric articles according to the present invention. As used herein, the term "refreshing" means cleaning, dewrinkling, and/or deodorizing fabric articles. The apparatus 10 includes a main housing or cabinet 12. The cabinet 12 forms an interior region 14 having opposite side walls 14*a* and 14*b*, a top wall 14*c*, a bottom wall 14*d* and a rear wall 14*e*. A door 16 is hingedly connected to the cabinet 12 for closing the interior region 14 formed by the cabinet 12. The door 16 includes an inner surface 16*a* wherein when the door 16 is closed, the rear wall 14*e* of the cabinet 12 and inner surface 16*a* of the door 16 form opposed inner side surfaces of the interior region. A gasket 17 is provided disposed about the periphery of the door 16 for sealing the interface between the door 16 and cabinet 12. Fabric articles are hung within the interior region 14 from a rod 18 extending from the rear wall 14*e* of the interior region 14. A mist of electrically charged liquid is sprayed into the interior region 14 through a fluid atomizing nozzle 20 (FIG. 2), mounted onto the side wall 14*b*. As described herein below, the present invention is con-figured such that the electrically charged liquid is uniformly applied to the hanging fabric articles for refreshing the fabric articles. As used herein, the term mist means atomized droplets of fluid which may contain solid particles in solution with the fluid. Effective distribution of the electrically charged liquid is important to achieving the desired benefits and is enhanced by selecting a mist form of the electrically charged liquid in which the mean particle diameter size is optimally chosen. To that end, the mean particle diameter size of the electrically charged liquid mist is preferably from about 30 microns to about 1500 microns, more preferably from about 60 microns to about 600 microns, and most preferably from about 100 microns to about 400 microns. Furthermore, it is preferable for the particular diameter size to have narrow particle size distribution to enhance even deposition on the fabric article.

For purposes of enhancing the effective distribution of the electrically charged liquid on the fabric articles, the misting of the electrically charged liquid can be achieved using any suitable spraying device such as a hydraulic nozzle, sonic nebulizer, high pressure fog nozzle or the like to deliver target particle sizes. However, the misting is preferably accomplished using a relatively low volume air atomization nozzle and/or a simple orifice. For example, spray nozzles commercially available from Spray Systems, Inc. (Model Nos. 850, 1050, 1250, 1450 and 1650) are suit-able.

Figure 2:
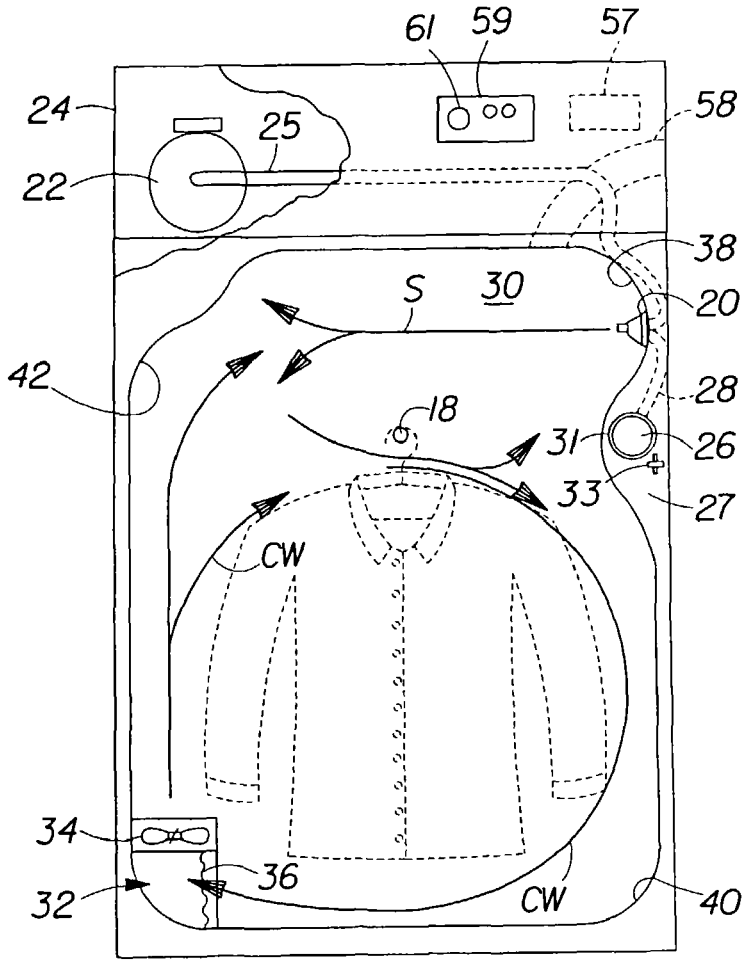
FIG. 2 is a schematic illustration of the flow of air and mist form of the electrically charged liquid within the apparatus of FIG. 1.

To achieve the misting of the electrically charged liquid within the interior region 14, a compressor 22 is provided which may preferably be supported in an upper housing 24 of the cabinet 12. The compressor 22 is connected to an air supply tube 25 which supplies air to the nozzle 20 (FIG. 2). Alternatively, the compressor 22 maybe housed in a base of the cabinet 12 with a supply tube extending upwardly to the nozzle 20. In embodiments where a simple orifice is used rather than an air atomization nozzle, the above-described elements are not needed.

The electrically charged liquid is supplied to the nozzle 20 from a reservoir container 26 which is removably supported within a 31 cavity formed into a baffle section 27 of the side wall 14*b* of the cabinet. The reservoir 26 is a generally cylindrical, bottle-like container and is releasably connected to a fluid supply tube 28 which ex-tends upwardly to the nozzle 20. Accordingly, the reservoir 26 is readily filled with electrically charged liquid by removing it from the side wall cavity and adding electrically charged liquid (in one embodiment, the liquid can be electrically charged by a high voltage wire from high voltage power supply being present in the reservoir). A release lever 33 may be provided which when depressed by the user causes the container 26 to be disconnected from the fluid supply tube 28 and partially ejected from the cavity 31. During misting periods, the air compressor is operated and electrically charged liquid is drawn up into the nozzle and sprayed in-to the interior region 14. The reservoir may be provided with a relief valve to prevent an undesirable vacuum condition from forming within the reservoir 26. However, again if a simple orifice is used, a displacement pump system is not necessarily needed.

As shown in FIG. 2, the fabric article treating apparatus 10 is configured to promote effective application of an electrically charged liquid onto fabric articles hanging within the interior region 14. To that end, the nozzle 20 is mounted to the side wall 14*b* near the top of the interior region 14 above the baffle section 27. The rod 18 is located below the top wall 14*c* such that the fabric articles hang within the interior region 14 below the nozzle 20. The electrically charged liquid is sprayed, as indicated by the arrows labeled S, in-to the open area of the interior region between the top wall 14*c* and the hanging fabric articles, referred to herein as a deceleration region 30. Within the unobstructed deceleration region 30, the mist sprayed from the nozzle 20 is given an opportunity to decelerate such that the mist is allowed to circulate gently within the interior region 14. In this regard, the deceleration region 30 is preferably 1.736 cu. ft. (10" by 10" by 30") or more of "dead" space, such that the spray has an adequate region to decelerate.

To provide for heating and moving air within the cabinet 12, a recirculation fan assembly 32 is provided with-in the lower portion of the interior region 14. The fan assembly 32 includes a fan 34 and a heater 36. The fan 34 is positioned to move air within the interior region 14 in a general clockwise direction, indicated by the arrows labeled CW. As can be seen, the movement of air within the cabinet 12 is opposed to the spray S of electrically charged liquid into the interior region 14. Accordingly, the recirculation of air acts to further decelerate the spray of electrically charged liquid.

Even and smooth air flow within the cabinet 12 is promoted by providing the interior region 14 with rounded corners 38, 40 and 42. Additionally, the baffle section 27 of the side wall 14*b* acts to promote recirculation of air within the lower portion of the interior region 14 below the deceleration region 30.

Figure 3:
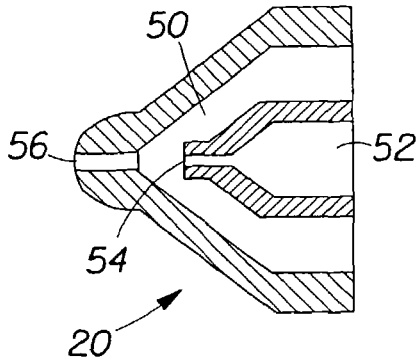
FIG. 3 is an illustration of the nozzle used to dispense the electrically charged liquid into the apparatus of FIG. 1.

As discussed above, the electrically charged liquid can be dispensed into the interior region 14 as a mist by combining it with an air stream under pressure and passing it through the atomization nozzle 20. FIG. 3 provides a general illustration of the configuration of the nozzle 20. As shown, the air from the compressor 22 is supplied to an annular, conically shaped air passage 50 of the nozzle 20. Preferably, the air provided from the compressor 22 has a pressure of from about 5 psi to about 30 psi. Optionally, the temperature of the air supplied from the compressor 22 can be heated to enhance distribution and deposition of the electrically charged liquid onto the hanging fabric articles. The fluid supply tube 28 of the reservoir 26 is connected to a fluid passage 52 centrally disposed within the air passage 50. Air flowing through the air pas-sage 50 passes over an outlet orifice 54 of the fluid pas-sage 52. The flow of air past the outlet orifice 54 creates a low pressure region that draws the liquid out of the reservoir 26. After being drawn through the outlet orifice 54, the electrically charged liquid is mixed with air and sprayed out though a nozzle outlet 56.

While not intending to be bound by theory, it is believed that the electrically charged liquid comes from the orifice 54 in fine strands. The surface tension of the electrically charged liquid and the shearing forces from impact with the nozzle outlet 56 break up the fine strands into smaller droplets. These droplets are carried away from the nozzle 20 by their initial momentum and the flow of air exiting the nozzle outlet 56.

Atomization in the method and apparatus of the present invention is achieved in one embodiment using electrostatic ligament atomization. The liquid is charged to high electrostatic voltage (at any place in the liquid supply system—doesn't make a difference as conductive liquids are used herein). The liquid is pumped through the liquid supply system and a simple orifice generates a hydro-jet. The jet breaks into charged droplets because the liquid surface is electrically charged to an energy level above its liquid surface tension with the result that the liquid surface becomes unstable and break-up occurs. The charged droplets are pulled towards the garment that rests at a lower (higher) electrical potential for positively (negatively) charged droplets. It is desirable that any excess charge is dissipated from the garment through the grounded hanger.

A controller 57 and control panel 59 (FIG. 2) is provided for operating the compressor 22 and fan assembly 32 in accordance with the cycle selected by the user of the clothes treating apparatus 10. The control panel may include a cycle selection knob 61 allowing the user to select a cycle that matches the type of clothes to be treated such as cotton, wool or delicate. The process for refreshing the fabric articles hung within the apparatus 10 preferably includes a first period of applying the electrically charged liquid in a mist form onto the fabric articles. The time for applying the electrically charged liquid may be between 10 and 30 minutes depending on the choice of cycle and the load size. While the electrically charged liquid is being supplied into the interior region 14, the fan 34 is energized to circulate air within the cabinet 12. Optionally, the heater 36 may be periodically energized for supplying heat to the distributed the electrically charged liquid.

Following the application of the electrically charged liquid, the heater 36 and fan 34 are energized such that warm air is recirculated over the fabric articles hanging with-in the cabinet and the electrically charged liquid applied to the fabric articles is dried. Preferably, the temperature of air during the drying period is in the range from 40 C. to about 80 C., more preferably from about 50 C. to about 65 C. The drying time period may be from 10 to 180 minutes long, depending on the cycle selected and load size. An exhaust air duct 58, shown in FIG. 2, may be provided for allowing air to be exhausted from the interior region 14 during the drying period. The exhaust duct 58 may be connected with duct work such that the exhaust air is vented out of the user's home as is conventional in dryer applications. The duct may be provided with a closing means such that the duct can be closed during the electrically charged liquid application step.

The particular electrically charged liquid selected for use in the process can vary widely depending upon the particular benefit desired. However, in preferable modes of operating the electrically charged liquid will contain ingredients which can be effective across a variety of fabric article types. For example, the electrically charged liquid will preferably be suitable for "dry-clean" only fabric articles as well as pure cotton dress shirts which typically require a significant de-wrinkling operating subsequent to conventional laundering operations (i.e. home washings and drying cycles).

Figure 4:
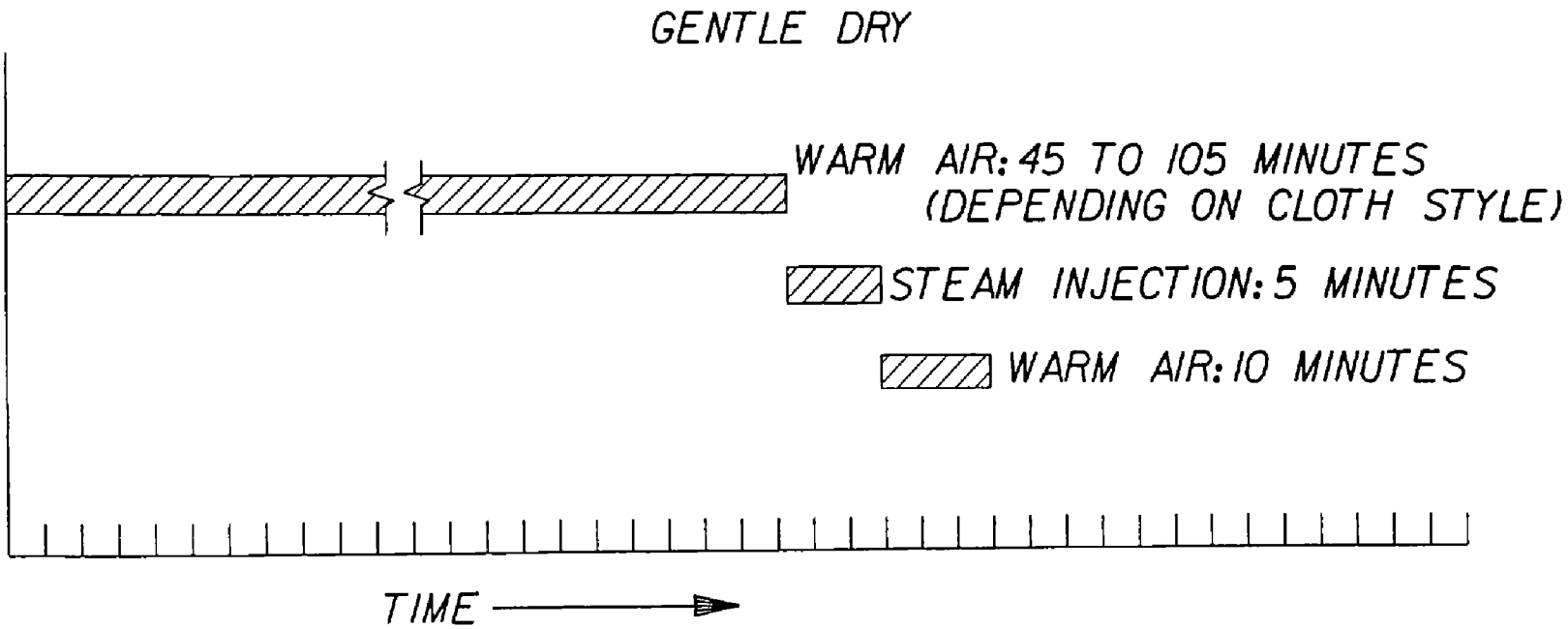
FIG. 4 is a chart illustrating an alternative operation of the present invention.

Once a fabric article is positioned within the fabric article receiving volume by the fixturing system, the fabric article is subjected to the electrically charged liquid. FIG. 4 illustrates a preferred cycle for treating the fabric article. A representative cycle is approximately 30 minutes in total length. During the steam period, steam is continuously supplied to adequately dampen the fabric article and then the electrically charged liquid is delivered to the fabric article. After contacting the fabric article with the steam and/or electrically charged liquid, the fabric article is then dried by any conventional means, such as by contacting the fabric article with hot air.

It can be seen, therefore, that the present invention provides a unique clothes treatment cabinet which effectively refreshes fabric articles by applying an electrically charged liquid onto the fabric articles without requiring the application of steam.

b. Collapsible/Expandable Container Apparatus

In another embodiment, an apparatus for treating a fabric article includes a collapsible or expandable container (housing) that is made from a material that defines an interior void space having an open volume of between about 0.75 $m^3$ and about 0.05 $m^3$, and an opening. The apparatus also includes a humidity provider; a heating element; a hanger for suspending at least one fabric article within the interior void space of the container; a vent; and an air circulation device. The container can be collapsed to at least about 50%, preferably at least about 40%, and more preferably at least about 25% of its open volume.

In one aspect of the present invention there is provided an apparatus for treating a fabric article comprising: a) a collapsible or expandable container that is made from a material, wherein the material defines an interior void space having an open volume of between about 0.75 $m^3$ and about 0.05 $m^3$, preferably between about 0.6 $m^3$ and about 0.1 $m^3$ between about 0.5 $m^3$ and about 0.2 $m^3$ and further comprising an opening; b) a humidity provider; c) a heating element; d) a vent; and e) an air circulation device.

Wherein the container can be collapsed to at least about 50%, preferably at least about 40%, and more preferably at least about 25% of its open volume. Preferably the material is a flexible material, more preferably is a coated fabric material that can withstand temperatures of about 100 deg. C. with essentially no increase in its vapor permeability or loss in mechanical properties. In one embodiment of this invention there is provided a hangar for suspending at least one fabric article within the interior void space of the container.

The apparatuses of this invention preferably comprise a temperature controller capable of changing and maintaining the air temperature within the interior void space of the container. Still, preferably, the humidity provider is a humidity controller capable of changing and maintaining the relative humidity of the air within the interior void space of the container.

The apparatuses of this invention also preferably weigh less than about 15 Kg, preferably less than about 10 Kg, and more preferably less than about 8 Kg, and even more preferably comprise an ozone source within the interior void space of the container that can be, for example an ultraviolet lamp, or even a high voltage source.

The present invention provides benefits over the prior art in that fabric articles can be cleaned and refreshed without the need for expensive mechanical apparatuses, such as a tumble clothes dryer. Moreover, fabric refreshment processes comprising two or more steps with regard to temperature and humidity can be accomplished in the present apparatuses. Further, the present invention provides an apparatus for delivering an active ingredient, for example, perfume, to the fabrics being treated. Simultaneously, the apparatuses herein minimize the amount of vapor delivered so that the actives are not wasted. And finally, the apparatuses herein are designed to deliver only enough vapor to accomplish the fabric treatment process, without the need for additional mechanical drying.

The present invention provides apparatuses for cleaning and refreshing fabric articles in a domestic, non-immersion process. The apparatuses are suitable for use in a cleaning and refreshing method that requires at least two steps, and preferably three. The temperature and relative humidity within the fabric treatment apparatus can be manipulated and controlled to create a warm, humid environment inside the container of the fabric treatment apparatus.

This controlled environment volatilizes malodor components in the manner of a "steam distillation" process, and moistens fabrics and the soils thereon. This moistening of fabrics can loosen pre-set wrinkles, and because the fabric articles are hung in the container new wrinkles do not form. Proper selection of the amount of the vapor, and specifically the amount of water used in the process and, importantly, proper venting of the container in the present manner can minimize shrinkage of the fabrics. Moreover, if the container is not vented, the volatilized malodorous materials removed from the fabrics, which are not captured by the filter if present, can undesirably be re-deposited thereon.

Relative humidity is a well known concept to those in the fabric care arts. As used herein, "relative humidity" means the ratio of the actual amount of water vapor in the air to the greatest amount the air can hold at the same temperature. Temperature and relative humidity controllers are well known to those skilled in the art, as are passive and active controllers.

As used herein, an "active" controller is a controller that reads an input and supplies feedback to the device being controlled and that device adjusts based on the feedback received.

A "passive" controller, as used herein, is a controller that turns a device on or off, or opens or closes a device, based on a predetermined setting such as time. For example, a passive temperature controller would turn on a heating element or close a vent to increase the temperature in a given environment and after a certain period of time the heating element is turned off or the vent is opened. In contrast, an active temperature controller reads the temperature and if, for example, the temperature is too low, the power to the heating element is increased or the vent is closed to increase the temperature.

As used herein "fabric articles" is meant to encompass any and all articles of manufacture that are made at least partially of a natural or man-made fibrous material. Examples of fabric articles include, but are certainly not limited to: toys, shoes upholstery, fabric articles, carpets, clothes hats, socks, towels, draperies, etc.

The fabric article treating apparatuses of this invention can take a variety of forms. But it is generally preferred that the apparatuses comprise a container that substantially encloses the fabric articles being cleaned and refreshed.

By "substantially encloses", it is meant that the fabric articles are enclosed in the container, but that the container can, and preferably will, include one or more vents.

The container must have an opening to access the fabric articles, and preferably, there is a bar, hook or other device on which to hang the fabric articles. The container preferably has only one wall configured like an egg shell. It has been found that the vapor, and subsequently the active ingredients, preferentially condense in the corners and along the sharp edges of a more conventional rectangular shaped cabinet. This is not to say that the methods of this invention cannot be conducted in rectangular cabinets; they can.

Regardless of its shape, every container has an "open volume" which as used herein means the volume of the container when it is in use. The containers of this invention are collapsible or expandable and have a substantially reduced volume in their closed or collapsed state.

Figure 5:
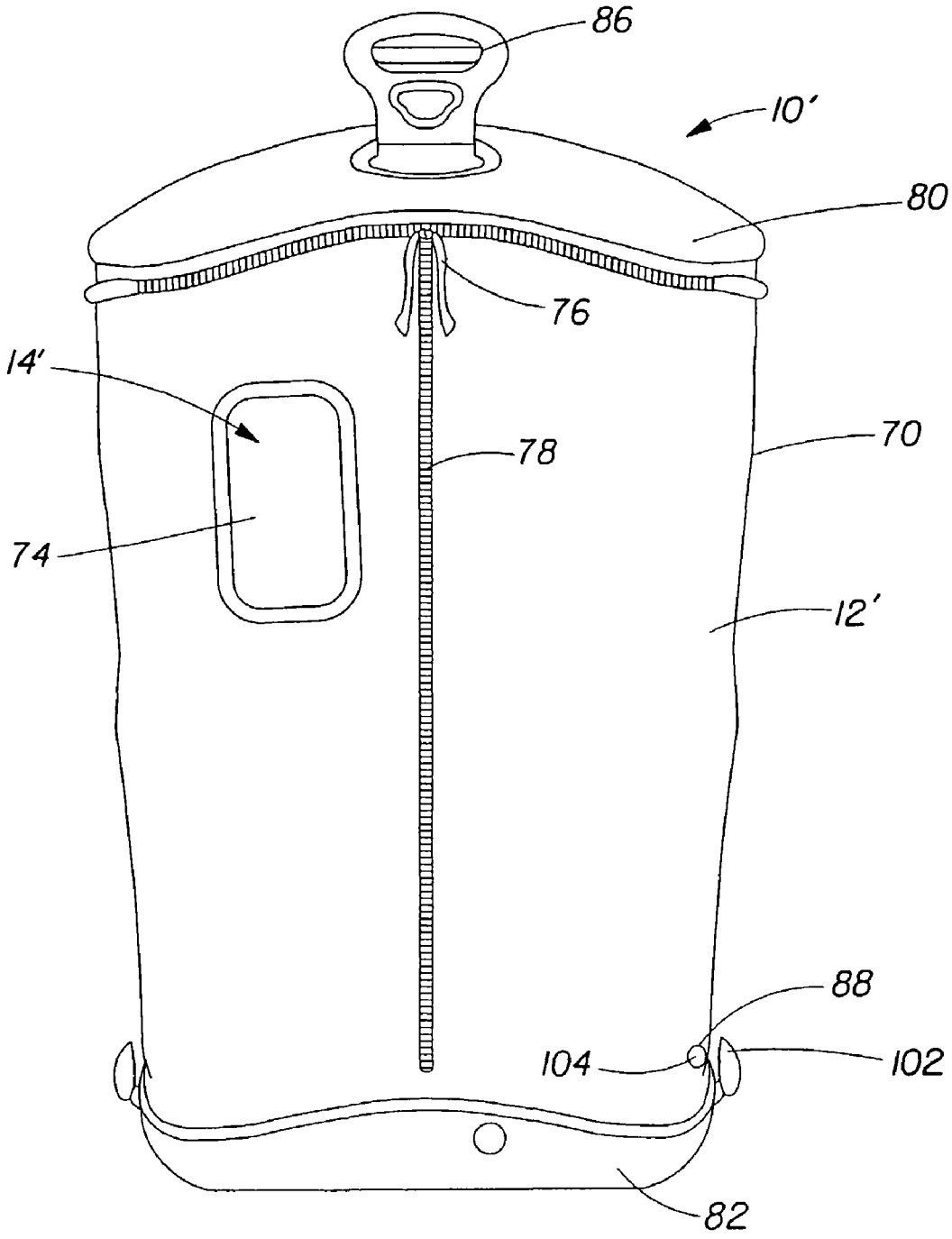
FIG. 5 is a schematic representation of another fabric article treating apparatus in accordance with the present invention.

Referring now to FIG. 5, which is a schematic representation of a fabric article treating apparatus 10' according to the present invention wherein the collapsible or expandable, preferably flexible walls 70 of container 12' are preferably made of a flexible material, which is preferably a lined fabric material. And more preferably the lining is a coating applied to the fabric by methods known to those skilled in the art such as transfer coating, direct coating.

The fabric is preferably selected from the group consisting of cotton, polyester, nylon, rayon and mixtures thereof, and the lining is preferably selected from the group consisting of silicone, polyurethane, polyvinyl chloride and mixtures thereof. Collapsible or expandable walls 70 of container (housing) 12' define an interior void space (fabric article receiving volume) 14', which is preferably supported by one or more rigid, yet collapsible frames 72 (shown in FIG. 6). These frames can be separate from one another, or they can be a unitary structure. Interior void space 14' can be viewed via window 74 if collapsible or expandable walls 70 are made of an opaque material.

It is understood that while treatment apparatus 10' is shown in a rounded rectangular configuration, the present invention is not meant to be so limited. Other structural configurations are appropriate for this invention, for example, pyramid, spherical, hemi-spherical, two-sided/fabric article bag and other configurations.

Treatment apparatus 10' can be any appropriate size and shape to achieve the desired volumetric sizes disclosed herein. Fastener 76, which seals opening 78, can comprise virtually any known sealing device such as zippers, tape, ZIP LOCK seals and hook and loop type fasteners, for example VELCRO.

Figure 6:
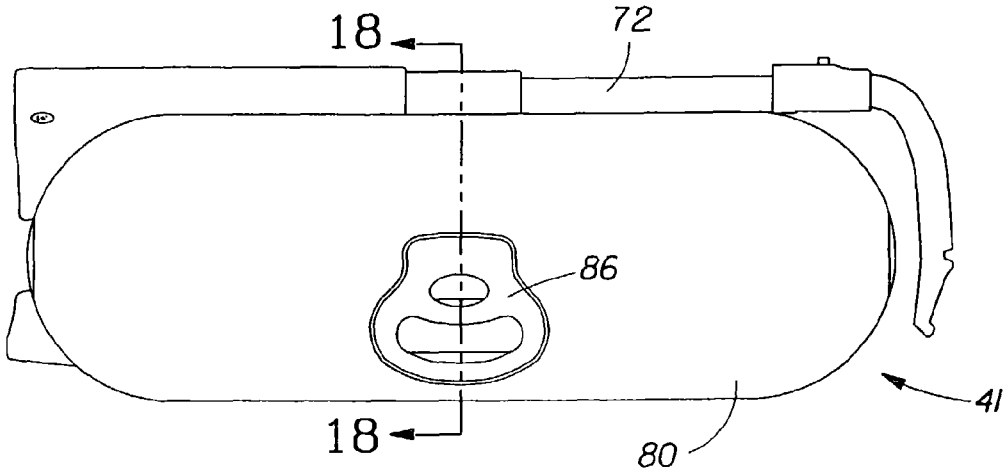
FIG. 6 is the top view of the apparatus of FIG. 5 after it has been collapsed.
Figure 7:
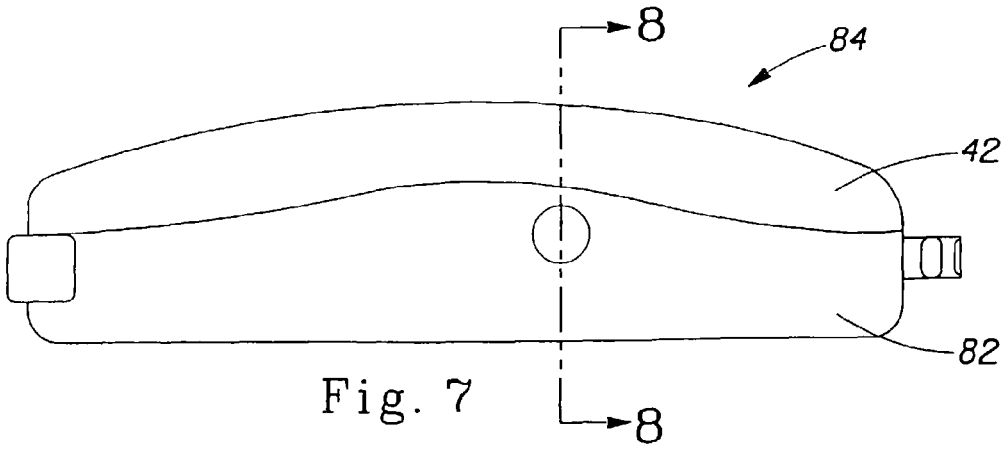
FIG. 7 is the front view of the apparatus of FIG. 5 after it has been collapsed.

Turning now to FIGS. 6 and 7 which are the top and front views of the fabric article treating apparatus of FIG. 5 after it has been collapsed. The containers of the present invention preferably comprise a rigid top portion 80 and a rigid bottom portion 82 that forms a receptacle 84 for the container when it is collapsed.

If a frame is employed, for example 72, the rigid portions of the container can serve a support for the frame, or the frame and the rigid portion can be separate items that are not connected to one another. Preferably the frame or frames form a flexible, collapsible structure that when expanded forms a semi-rigid, three dimensional structure.

Examples of collapsible structures are known, for example, in U.S. Pat. No. 5,038,812, which issued on Aug. 13, 1991, to Norman. The entire disclosure of the Norman patent is incorporated herein by reference. In general, flexible, collapsible frames, such as those found in Norman, are formed from material that is relatively strong but nevertheless flexible enough to allow it to be collapsed. An exemplary frame material is flat spring steel having a rectangular cross section with dimensions of 1.6 mm in width and 76 mm in length. The frame or frames can be sewn, glued or otherwise attached to the interior or the exterior of the treatment bag. Likewise, the frame or frames can be free standing with the treatment bag material hanging loosely over, or being expanded by the frame.

As is discussed briefly above, the apparatuses of this invention are collapsible. That is, the container can be folded to substantially reduce its volume. More preferably, the container collapses into a receptacle that can be formed by the rigid portions of the container, or the receptacle can be a separate item. The receptacle need not be rigid, but can be any suitable storage unit for the collapsed container.

Preferably the container comprises a handle that makes it easier to transport the collapsed container from one place to another. Even more preferably, the handle also serves as the exterior hanging means 86, which is used to hang the apparatus in use and can be used as a handle to carry receptacle 84 when apparatus 10' is collapsed. To facilitate numerous cycles of collapsing and un-collapsing, the collapsible or expandable, preferably flexible material must be reasonably durable.

By durable it is meant that the container should resist mechanical and chemical stress, that is the material should not swell, soften or develop cracks, holes, or other defects during its normal use. Likewise, if the container is constructed of a lined material, the lining should not deteriorate or exfoliate. In one preferred embodiment of this invention, the container is also thermally insulated with additional material, or even more preferably, the flexible material is a thermally insulating material. But as is discussed below in the Method description, there is a need for relatively quick "cool-down" of the bag which allows for condensation of the perfume on the fabrics. Thus, the bag should not be perfectly insulated.

The collapsible and/or expandable, preferably flexible, material should have a natural vapor permeability not higher than 3000, preferably, not higher than 2000, and more preferably not higher than 1000 grams of water/m2/day. Vapor permeability can be measured by a standardized test such as the ASTM E96 test, which will be known to those skilled in the art. The collapsible or expandable, preferably flexible, material can be essentially vapor impermeable, but it may be desirable for the container walls to have some limited permeabilty so the container can "breathe". Also, the collapsible and/or expandable, preferably flexible, material should be resistive to chemical corrosion, and ultra violet light.

The various materials listed below as suitable fabric article actives present in the electrically charged liquid should not damage the container material over time. Likewise, the apparatuses of this invention may be used near a window wherein the sunlight might fade or otherwise damage the material.

The container material should be selected to minimize this degradation due to natural sources.

Suitable collapsible or expandable, preferably flexible, materials can be purchased from the Milliken Corp., in South Carolina, or the Sofinal Corp., in Belgium.

The containers of this invention can be formed from one sheet of collapsible or expandable, preferably flexible, material or from multiple sheets of material that are joined together in any appropriate manner. Those skilled in the art can contemplate many ways to join multiple sheets of material together to form a container. For example, the sheets can be sewn together, stapled, adhesively bonded, heat bonded, some bonded, or attached to one another by means that are known. The seams of container 12', if properly engineered, can form the container vent. By properly engineered, it is meant that the welds, stitches, bonds, staples, etc. of the container should be spaced so as to vent the desired amount of air during operation. Those skilled in the art will be able to determine the proper seam construct to achieve the desired venting without undue experimentation.

In addition to the at least one wall that defines an interior void space, the containers of this invention preferably comprise: a vent 88; a temperature controller 90 that is preferably active and is capable of changing and maintaining the air temperature within the interior void space 14' of container 12'; a humidity provider 92 (shown in FIG. 8) that is preferably passive and is capable of changing and maintaining the relative humidity of the air within the interior void space 14' of container 12'; a heating element 94, which is capable of heating liquids to produce vapors and which can run dry to heat air; and an air circulation device 96, for example, a fan.

Preferably, for the optimum deodorization, it preferred to have air velocities around the fabric article between 0.05 to 10 m/s, more preferably between 0.1 and 5, most preferably between 0.5 and 2 m·s-1.

Preferably, the active temperature controller 90, the humidity provider (controller) 92, the heating element 94, and the air circulation device 96 are all within the interior void space 14' of container 12'. Necessarily air circulation device 96 has an air inlet 98 and an air outlet 100, and it is preferred, that both air inlet 98 and air outlet 100 are located within interior void space 14' of container 12' so that at least a portion of the air within the interior void space 14' of container 12' is recirculated. Likewise, air outlet 100 is at least about 30 cm, preferably at least about 25 cm, and more preferably at least about 20 cm from vent 88 such that a portion of the air circulated within the interior void space 14' of container 12' is vented to the exterior of the container.

The vent is preferably selected from the group consisting of the natural permeability of the flexible material, seams created between sheets of the flexible material, seams between the container opening and the flexible material, a void space in the container material, and mixtures thereof. By void space in the container material it is meant that the vent can be any appropriately sized hole or opening. The filter 102 can also be a component of the apparatus. The filter 102 is preferably located at the top of the apparatus or at the bottom in either close proximity to the fan, thereby removing the need for a vent and the apparatus may then work in close system or under the cover plate in close proximity to the heating element.

Preferably the filter 102 is in close proximity, e.g. adjacent, the vent. Even more preferably the apparatus, most preferably the vent comprises a humidity sink, e.g. condenser 104 for condensing vapors before they are emitted from the container.

Preferably the filter comprises an absorbent material, for example, activated carbon, to absorb fugitive chemicals, perfumes, malodorous compounds before they are emitted to the exterior of the container. Most preferably, the filter is a low pressure filter that has a low resistance to air. Typical of such filter are commercially available from AQF under the trade name CPS@ or from MHB filtration. Preferably, part up to the total surface of the air circulation device, e.g. fan may be covered by the filter. If part of the air circulation device is covered, lost of the perfume through the filter is minimized whilst when the whole air circulation device is covered one can have the air circulation device automatically switched off upon the end of the cycle thereby enabling deposition of the perfume onto the fabric article.

Condensers and filters are well known to those skilled in the apparatus arts. The apparatuses of this invention utilize hot vapors to clean and refresh fabric articles as described above.

The vapors are typically created within the container by vaporizing a cleaning and refreshment composition (i.e., an electrically charged liquid containing one or more fabric care actives), which comprises water and actives. The water and actives, that is, the "cleaning and refreshment composition", or "fabric treatment composition" (these two terms are used interchangeably throughout this description and are intended to mean the same thing), can be added to the container in any appropriate way. The composition can be poured into the bag, poured into a reservoir that feeds into the heating element/humidifier, canisters can be used to inject the composition, or an absorbent substrate saturated with the composition can be placed in the bag.

Substrates and compositions suitable for use in the methods of this invention are described in greater detail below. It is understood that those skilled in the art will know of other methods of adding actives to the container and those methods are within the scope of this invention.

As discussed above, the apparatuses of this invention comprise a heating element and an air circulation device that work together to vaporize and distribute the cleaning and refreshment composition. By "work together" it is meant that the heating element is in fluid communication with the air outlet of the air circulation device such that as air is circulated within the interior void space of the container it contacts the heating element.

Moreover, it is especially preferred that the heating element be in fluid communication with a fabric treatment composition that is vaporized by the heating element.

Figure 9:
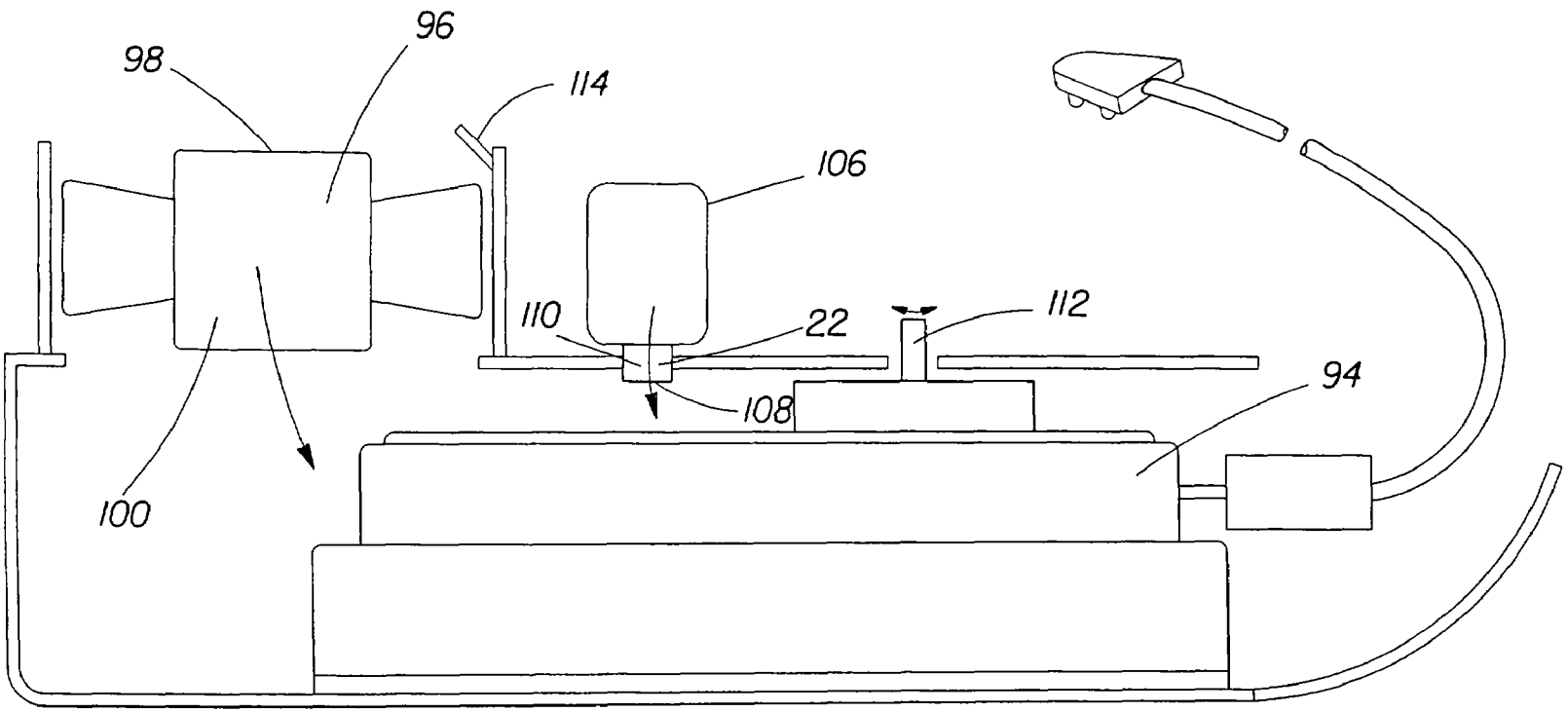
FIG. 9 is a schematic drawing of one possible arrangement of the mechanical components of the apparatus of FIG. 5.

One such mechanical system is shown in FIG. 9, which is a schematic drawing of one possible arrangement of the mechanical components of the present invention. The fabric treatment composition is circulated throughout the interior void space of the container as air is circulated across the heating element carrying the vaporized fabric treatment composition.

Figure 8:
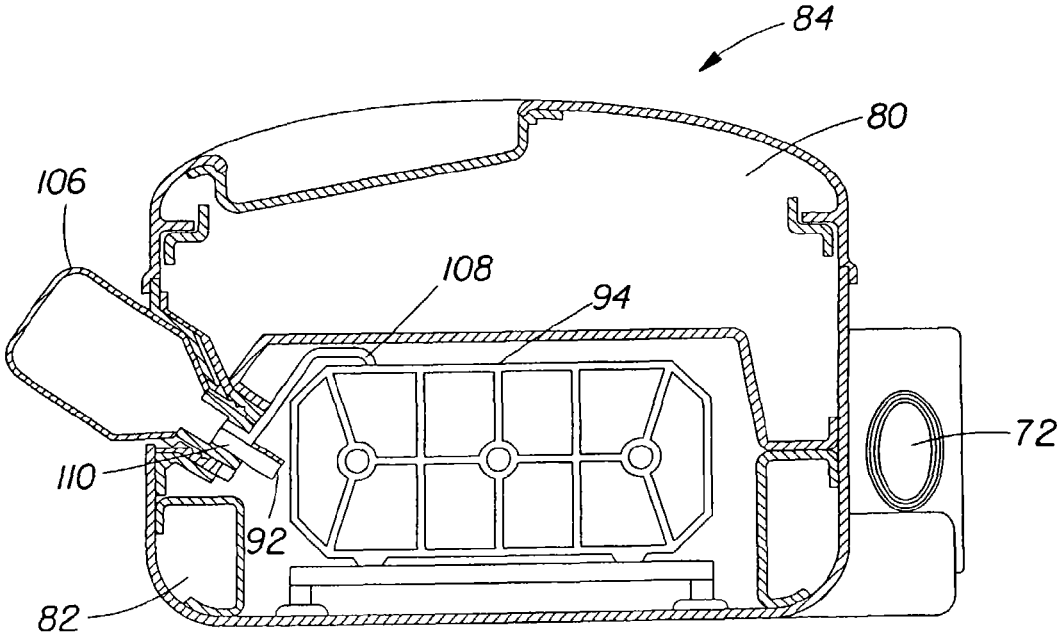
FIG. 8 is a cross sectional view taken along line 8-8 of the apparatus of FIG. 7, wherein a source of electrically charged liquid in the form of a canister containing a liquid to be electrically charged has been added.

A cartridge 106 is shown in FIG. 8, which is a cross sectional view of a fabric treatment apparatus of the present invention preferably comprise. The fabric treatment composition is contained within cartridge 106 having a cartridge outlet 108, wherein the cartridge outlet is in fluid communication with the heating element 94 via cartridge receiver 110.

The mechanical elements of apparatus 10' comprise, at a minimum, humidity provider 92, heating element 94, and, as discussed above, air circulation device 96.

Preferably, the apparatus also comprises a temperature controller 112. In a preferred aspect of this invention, heating element 94 serves to heat both the air and to vaporize the cleaning and refreshment composition. The vaporized cleaning and refreshment composition raises the humidity within the interior void space 14' of container 12'. Humidity provider 92 is generally passive, that is it is preprogrammed to turn on and off based on the amount of vapor necessary to achieve the desired humidity. In contrast, temperature controller 112 is preferably active, that is the temperature is read with temperature probe 114 and this temperature is sent back to temperature controller 112. Based on the input from temperature probe 114, temperature controller 112 raises or lowers the temperature of heating element 94. Alternatively, heating element 94 can be turned on or off based on the input from controller 112. Each of these mechanical elements will be known to those skilled in the apparatus arts, and the size and power of each element can be selected based on the volume of the container.

Many manufacturers market these elements, such as, Etri in France, Blackmann in Austria, and IRCA in Italy.

While the apparatus described above arguably performs the function of a classic "steamer", it additionally heats and circulates dry air throughout the interior of the container. By this method both humidity and temperature can be controlled independently, which is not the case with prior steam generating apparatuses. The vapor can be supplemented by a nebulizer, atomizer or the like device (not shown), which can be used to spray a fine mist of volatile and involatile cleaning and refreshment compositions.

In addition to distributing a fine mist of the cleaning and refreshment composition throughout the interior of the container, the nebulizer can be used as the humidity provider as well. Preferably the nebulizer is an ultrasonic device, most preferably providing droplets size between 1-60 microns, most preferably between 1-40 microns.

Nebulizers, atomizers and the like devices that are appropriate for use in the present invention are well known to those skilled in the art. A suitable device for use herein is a nebulizer which has an ultrasonic nozzle. Typical of such nebulizer is commercially available from Sono Tek Corporation, 2012 route 9W Building 3 in Milton N.Y. 12547 under the tradename Acu Mist@.

If used, it is preferred to have frequency set up to at least 60 kHz, most preferably to at least 100 kHz so as to obtain droplets sizes below 60 microns, more preferably below 50 microns, most preferably below or equal to 40 microns. Still other examples of such devices can be purchased from the Omron, Health Care, GmbH, Germany, Flaern Nuove, S.p.A, Italy. Likewise, aerosol delivery systems, which are well known to the art, can be used to deliver the cleaning and refreshment compositions. More preferably, the nebulizer comprises protected cells. Indeed, a problem encountered with the use of cell containing nebulizer is their contamination from contact with the cleaning/refreshing composition, thereby causing build-up on the cell. As a result, the life time of the cell is shortened. It has now been found that protection of the cell, in particular by contacting the cell with a protective medium, e,g demineralized water, the latter being covered by a membrane, so that this system is closed, i.e. leak-free, solved this problem. Accordingly, the membrane is defined as providing the closing of the system but does not prevent the energy waves transmittal.

Subsequently, the cleaning/refreshment composition is added on top of this system. As a result, the lifetime of the cells are greatly enhanced. One advantage of this system is that it can be run empty of cleaning/refreshment composition without the risk of destroying the cell and thus the nebulizer. Preferably, the membrane is a layer made of plastic film, and/or made of metal. Typical description of such apparatus can be found in a co-pending application BE 9900683 filed 14 Oct. 1999 in the name of Brodsky SPRL. This finding is all the more surprising as previous attempts to solve this problem were by level detectors.

However, this did not prevent the build-up from the cleaning/refreshment onto the cell. In addition, it has also been found a means to improve the low output of the nebulizer. Indeed, another problem encountered with conventional nebulizer is that of the coalescence of the droplets. Indeed, as the droplets are emitted into the air, the higher they are the more they coalesce therefore giving bigger droplets and thus falling back into the basin of the nebulizer.

The present invention solved this problem in a simple manner by the addition of a blowing means like a fan, which is preferably located on top of the nebulizer so as to provide a horizontal air flow and hence directing the flow of small droplets through a grid. Typical description of such apparatus can be found in a co-pending application BE 9900682 filed 14 Oct. 1999 in the name of Brodsky SPRL.

Figure 10:
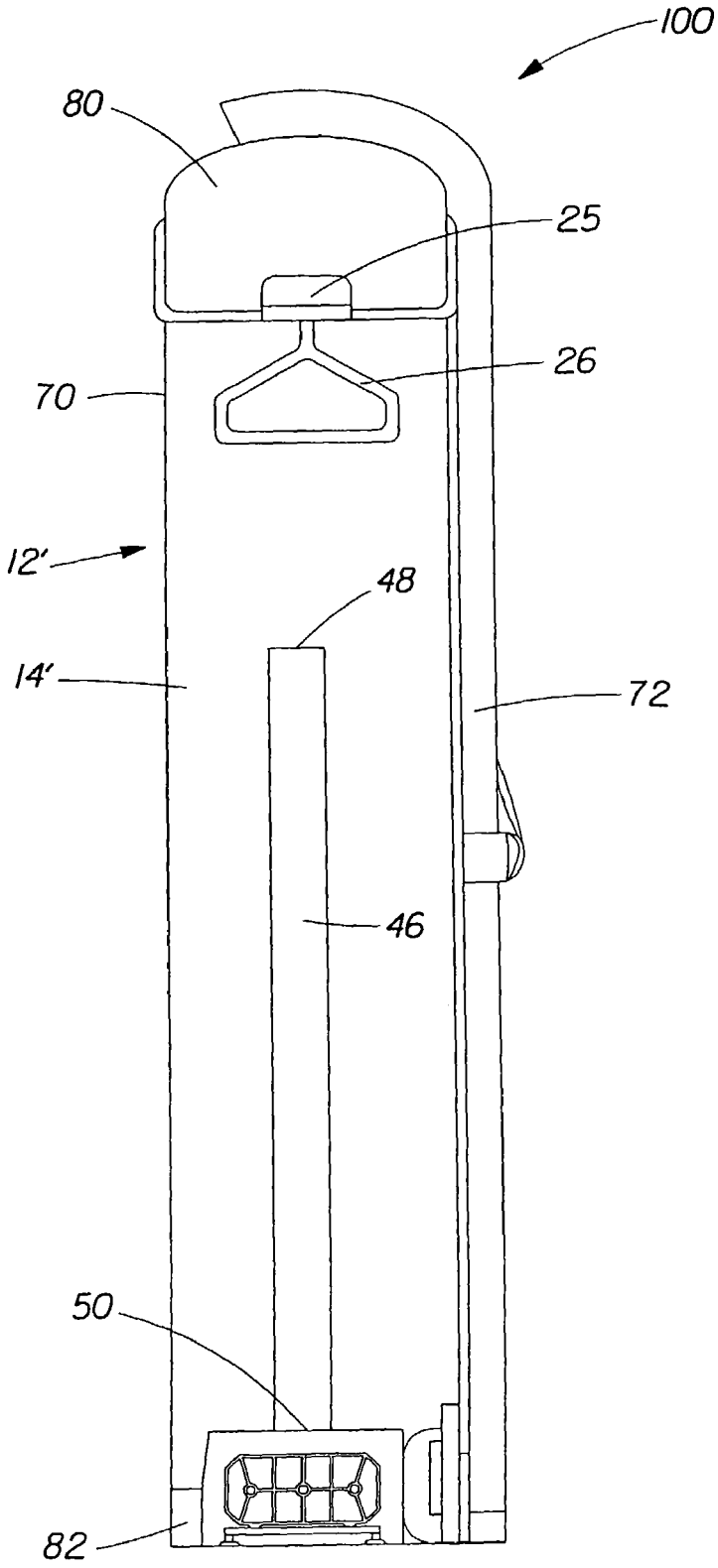
FIG. 10 is a lengthwise cross sectional view along line 18-18 of the apparatus of FIG. 5.

In one preferred aspect of this invention, as shown in FIG. 10, which is a lengthwise cross sectional view of a fabric treatment apparatus 100 comprising a conduit 46 according to the present invention. More specifically, apparatus 100 comprises a conduit 46 having a conduit inlet 48 and a conduit outlet 50 wherein conduit outlet is in fluid communication with the air inlet 36 of the air circulation device 34 and wherein the air outlet 38 of air circulation device 34 is at least 25 cm, preferably at least about 30 cm and more preferably at least about 35 cm from conduit inlet 48.

Conduit 46 can be any appropriate device that air can flow through relatively unobstructed. For example a pipe, made of plastic or other materials can be used. An especially preferred conduit is a pipe having an interior diameter of from about 2 cm to about 10 cm.

Fabric articles can be suspended in the interior void space 19 of treatment apparatus 10 by any appropriate method. One such method is shown in FIG. 10 wherein a bar 25 is provided to suspend hangars 26. The fabric articles hung in treatment apparatus 10 can also be weighted or stretched to improve wrinkle reduction. Hanging weights and stretching devices will be known to those skilled in the art.

Preferably, the fabric articles to be treated are mechanically stretched after placing them into the container and before starting the process. This stretching or so-called tensioning of the fabric article helps the relaxation of wrinkles during the process. Preferred stretching systems include weighted as well as light-weight compactable or retractable stretching systems, wherein the system comprises a tensioning device like a spring.

The latter systems have the benefit of not adding extra weight to the cleaning and refreshing apparatus, along with the possibility of adjusting tensioning force and direction as required.

Preferably, these systems are mounted inside the container at its bottom. One example of such as system is a rollerblind that is conventionally used as sunfilters for cars and commercially available from Halfords. This system is a rollerblind which can be extended or compacted by means of a roll-up spring mechanism.

Only slight modification of this system is needed to adapt it to the tensioning of fabric article. One preferred adaptation involves attaching the housing of this system at the bottom of the apparatus and providing one or more clamp at the other side so that the clamping and thus the stretching or tensioning of the fabric article in the apparatus is obtained. The tension of the spring can also be adjusted to the desired stretching force for a given fabric article. The size of the clamp can vary so that more than one clamp are attached to this system. Still, another variation involves having only one clamp which run along or partly along the blind tensioning system located opposite the housing of the system.

Treatment apparatus 10 can be free standing with the support of a rigid frame 44, or it can be suspended by a hanging member 45 from a support means (not shown). If treatment apparatus 10 is suspended by hanging member 45 no frame is required although frames are generally preferred to control and maintain the shape and volume of interior void space 19. In a preferred embodiment of the present invention the container further comprises a rigid bottom portion 40, a rigid top portion 42 or both. These two rigid portions can be used to support the frame, house the mechanical elements of apparatus 10, and/or to serve as a housing for the collapsed container. Moreover, rigid bottom portion 40 and rigid top portion 42 can be designed to enhance the aesthetic characteristics of the apparatus, that is, there need not be any functionality to the rigid portions.

Volume Refreshment Rate

The apparatuses of this invention must simultaneously clean and refresh fabrics with vaporous compositions, and vent out the malodorous vapors. It is understood that separating the desirable active vapors from the malodorous vapors would be a complex task.

To simplify the apparatuses of this invention a Volume Refreshment Rate has been determined that optimizes the venting of malodorous compounds while minimizing the loss of active components from the cleaning and refreshment composition.

The Volume Refreshment Rate is defined as the frequency that the total volume of air within the interior void space of the container is replaced, expressed in units of seconds$^{-1}$. If the apparatus vents substantially lower than 0.0004 $s^{-1}$ then venting becomes too weak, and deodorization performance deteriorates unless the cycle length is drastically increased. Theoretically, without wishing to be bound, one volume refreshment per cycle could be enough to allow good deodorization. Supposing, for example, a cleaning and refreshment cycle takes 1 hour, of which the deodorization step would take approximately 40 minutes, this would mean a VR/s of 0.0004 s-1.

An exemplary Volume Refreshment Rate calculation is given in Example I below. The Volume Refreshment Rate for the apparatuses of the present invention is preferably between about $0.0004^{s-1}$ about $0.05^{s-1}$, and more preferably between about $0.001^{s-1}$ and about $0.03^{s-1}$.

Electrically Charged Fabric Article Treating Apparatus

In another embodiment, the fabric article treating apparatus may be electrically charged. Preferably the interior of the fabric article treating apparatus is charged. The fabric article treating apparatus alone may be electrically charged or it may be charged in addition to the fabric article being electrically charged. If the fabric article is also being charged, the electrical charging of the fabric article treating apparatus may occur prior to electrically charged liquid contacting the fabric article. Preferably the fabric article treating apparatus is electrically charged at the time the liquid contacting the fabric article is delivered from the nozzle. The fabric article treating apparatus may be comprised of a number of different materials. Non-limiting examples of suitable materials include but are not limited to natural or synthetic fibers. The electrically charged fabric article treating apparatus has an applied potential in the range of from about 0.2 to about 50 kV, preferably from about 0.5 to about 30 kV, and more preferably from about 0.75 to about 25 kV.

The source of the electrical charge for the fabric article treating apparatus comprises an electrical charging component, which is typically an electrical field that electrically charges the fabric article treating system.

One non-limiting example of the source of the electrical charge for the fabric article treating apparatus is an electrical lead through which the fabric article treating apparatus is electrically charged. In one embodiment, the electrical charging component is integral with the fabric article treating apparatus. In another embodiment, the electrical charging component is separate and discrete from the fabric article treating apparatus.

Further yet, the source may comprise an adjusting component capable of controlling the polarity and/or strength of the dispensing of the electrical charge to the fabric article treating apparatus. In other words it is possible to control whether the fabric article treating apparatus is positively or negatively charged. It is also possible to control the amount of voltage such that a user can determine how much voltage needs to be applied to the fabric article treating apparatus in order to achieve the end result (for example, it may be desirable to minimize deposition onto the fabric article treating apparatus). It may also be desirable to charge the fabric article treating apparatus the same as that of the fluid, so as to direct the charge to the fabric instead of the fabric article treating apparatus.

Still further yet, the fabric article treating apparatus could be made up of intertwined fibers used in the construction of the fabric article treating apparatus. The fibers may be conductive. The conductive fibers could be natural in origin, synthetic in origin or a combination thereof and either incorporated into the fabric article treating apparatus during construction or post assembly. Non-limiting examples of suitable methods to incorporate the conductive fibers into the fabric article treating apparatus include sewing the fibers into the fabric article treating apparatus, bonding the fibers to the fabric article treating apparatus bonded with an adhesive or some other fastening device. Other suitable conductive materials include but are not limited to polymers, graphite, activated carbon or combinations thereof. Conductive materials may also be applied by spraying the surface of the fabric article treating apparatus post construction. Combinations of conductive materials may be used.

In one embodiment, the source of the electrically charged fabric article treating apparatus comprises:

e. a material made of conductive material;

f. a collapsible bag in solid communication with the electrical source, wherein the bag has at least one contact point through which an electrical charge passes during delivery of the fluid to the fabric article;

g. an electrical charging component for electrically charging the collapsible bag to be electrically charged; and h. a means for grounding the fabric article being treated for the purpose of charge dissipation, said means for grounding comprising: i) a connector in electrical contact with the low level voltage output of the generator and which is maintained at low or zero electrical potential; and ii) a pin or other fastening means in electrical contact with the fabric article and which is capable of being electrically isolated from the connector and from ground, and wherein in use, the connector and fastening means are brought into electrical connection in order to establish a charge-dissipation grounding loop. Additionally, the collapsible bag could be insulated by another non conducting layer that would enable the consumers to interact with the bag without any potential for electrical shocks.

Typically, the collapsible bag, is either electrically charged prior to dispensing of the fluid during the dispensing of the fluid, or a combination thereof.

When the fabric article treating apparatus is comprised of an electrically charged fiber that is a conductive natural or synthetic fiber, it is desirable that the fiber have a resistivity lower than about $10^4$ ohm cm. However, higher resistivity fiber can also be effectively utilized using the methods and apparatuses of the present invention.

The fabric article fixturing system if desired can also be electrically charged either alone or in combination with either the fabric article and/or the fabric article treating apparatus. The fabric article fixturing system is electrically charged in like manner to that of the fabric article treating apparatus as described above.

Method

A method for treating a fabric article with the following steps: placing the fabric article in a container having an opening and at least one wall that defines an interior void space. Then the temperature and relative humidity of the air within the interior void space of the container are raised to a predetermined first temperature and a predetermined first relative humidity for a predetermined first period of time. Finally, at least one of the temperature or the relative humidity of the air within the interior void space of the container are changed at the end of the first period of time to a predetermined second temperature and a predetermined second relative humidity for a predetermined second period of time. This document was created using Optical Character Recognition (OCR) technology. The quality of the text generated by the OCR process directly depends on the quality of the image. Please refer to the document image to see the original text as published.

In one aspect of the present invention there is provided a method for treating at least one fabric article comprising the steps of. a) placing the Fabric article in a container having an opening and at least one wall that defines an interior void space; b) raising the temperature and relative humidity of the air within the interior void space of the container to a predetermined first temperature and a predetermined first relative humidity for a predetermined first period of time; and c) changing at least one of the temperature or the relative humidity of the air within the interior void space of the container at the end of the first period of time to a predetermined second temperature and a predetermined second relative humidity for a predetermined second period of time. In a preferred aspect of this invention, the fabrics are contacted with an aqueous composition prior to be placed in a container according to step a) defined below. In another preferred aspect of this invention vapor is used to raise the temperature and relative humidity of the air within the interior void space of the container, and more preferably the vent remains open at all times. In another aspect of this invention the vapor introduced into the interior void space of the container comprises water and a perfume. In yet another aspect of the present invention there is provided a method for treating a fabric article comprising the steps of: a) placing the fabric article in a container having an opening and at least one wall that defines an interior void space; b) introducing ozone into the interior void space for a predetermined first period of time; and c) changing at least one of the temperature or the relative humidity of the air within the interior void space of the container at the end of the first period of time to a predetermined second temperature and a predetermined second humidity for a predetermined second period of time. The ozone can be generated by an ozone source, such as an ultraviolet lamp, or even a high voltage source, within the interior void space of the container. Preferably, the level of ozone that is provided within the container is between 0.5 and 200 ppm, preferably between 0.5 and 50 ppm, more preferably between 0.5 and 20 ppm. Levels lower than 0.5 ppm are not preferred as they would not provide sufficient bleaching performance and consequently not provide sufficient performance of the benefit linked to the bleach property. The present invention provides benefits over the prior art by defining the optimal process steps for cleaning and refreshing delicate fabric articles in an in-home non-immersion cleaning process. The methods of this invention can be carried out in any appropriate container, such as a plastic bag, a wardrobe, a cabinet, or a tumble dryer. Unlike many prior processes, the methods of this invention involve at least two distinct steps, and preferably three steps. It has been surprisingly found that the optimal conditions for deodorizing a fabric article differ from the conditions that are best for dewrinkling. Likewise, perfume deposition onto a fabric article requires a third set of conditions for optimal performance. In the multi-step processes of this invention temperature, relative humidity or both can be manipulated and controlled. Alternatively, one step of the process can involve the introduction of ozone into the container to neutralize odor causing chemicals on the fabric articles being cleaned and refreshed. Further the present invention provides a method of delivering an active ingredient, for example, perfume, to the fabrics being treated. Simultaneously, the methods herein minimize the amount of vapor delivered so that the actives are, not wasted. And finally, the methods herein are designed to deliver only enough vapor to accomplish the fabric treatment process, without the need for additional mechanical drying.

The present invention provides methods for cleaning and refreshing fabric articles in a domestic, non-immersion process. The methods require at least two steps, and preferably three. The methods can be carried out in any appropriate apparatus wherein temperature and relative humidity can be manipulated and controlled. In another aspect of this invention, one of the method steps involves the introduction of ozone into the container to neutralize odor causing chemicals on the fabric articles being cleaned and refreshed. A warm, humid environment inside the container volatilizes malodor components in the manner of a "steam distillation" process, and moistens fabrics and the soils thereon. This moistening of fabrics can loosen pre-set wrinkles, and because the fabric articles are hung in the container new wrinkles do not form. Proper selection of the amount of the vapor, and specifically the amount of water used in the process and, importantly, proper venting of the container in the present manner can minimize shrinkage of the fabrics. Moreover, if the container is not vented, the volatilized malodorous materials removed from the fabrics, which are not captured by the filter if present, can undesirably be re-deposited thereon. Relative humidity is a well known concept to those in the fabric care arts. As used herein, "relative humidity" means the ratio of the actual amount of water vapor in the air to the greatest amount possible at the same temperature. Temperature and relative humidity controllers are well known to those skilled in the art, as are passive and active controllers. As used herein, an "active" controller is a controller that reads an input and supplies feedback to the device being controlled and that device adjusts based on the feedback received. A "passive" controller, as used herein, is a controller that turns a device on or off, or opens or closes a device, based on a predetermined setting such as time. For example, a passive temperature controller would turn on a heating element or close a vent to increase the temperature in a given environment and after a certain period of time the heating element is turned off or the vent is opened. In contrast, an active temperature controller reads the temperature and if, for example, the temperature is too low, the power to the heating element is increased or the vent is closed to increase the temperature.

Electrically Charged Liquid

The electrically charged liquid of the present invention may comprise water and/or some other solvent or liquid vehicle so long as the liquid is capable of being electrically charged and thus, carrying a potential.

It is highly preferred that the electrically charged liquid comprises one or more fabric article actives. The electrically charged liquid comprising one or more fabric article actives is also referred herein as a cleaning/refreshment composition.

The cleaning/refreshment composition preferably comprises water and optionally a member selected from the group consisting of surfactants, perfumes, preservatives, bleaches, auxiliary cleaning agents, shrinkage reducing compositions, organic solvents and mixtures thereof.

The preferred organic solvents are glycol ethers, specifically, methoxy propoxy propanol, ethoxy propoxy propanol, propoxy propoxy propanol, butoxy propoxy propanol, butoxy propanol, ethanol, isopropanol, wrinkle removing and/or reducing agents, in-wear anti-wrinkling agents, semi-durable press agents, odor absorbing agents, volatile silicones and mixtures thereof.

Fabric shrinkage reducing compositions that are suitable for use in the present invention are selected from the group consisting of ethylene glycol, all isomers of propanediol, butanediol, pentanediol, hexanediol and mixtures thereof. More preferably, the fabric shrinkage reducing compositions are selected from the group consisting of neopentyl glycol, polyethylene glycol, 1,2-propanediol, 1,3-butanediol, 1-octanol and mixtures thereof.

The surfactant is preferably a nonionic surfactant, such as an ethoxylated alcohol or ethoxylated alkyl phenol, and is present at up to about 2%, by weight of the cleaning/refreshment composition.

Preferred auxiliary cleaning agents include cyclodextrins and dewrinkling agents, such as silicone containing compounds. Especially preferred anti-wrinkling agents include volatile silicones, some of which can be purchased from the Dow Corning Corporation. One such volatile silicone is decamethylcyclopentasiloxane ("D5").

Typical fabric cleaning/refreshment compositions herein can comprise at least about 80%, by weight, water, preferably at least about 90%, and more preferably at least about 95% water. A more detailed description of the individual components of the cleaning/refreshment compositions, that is, the organic solvents, surfactants, perfumes, preservatives, bleaches and auxiliary cleaning agents can be found in U.S. Pat. No. 5,789,368, which issued on Aug. 4, 1998 to You et al. Additionally, cleaning/refreshment compositions are described in co-pending U.S. patent application Ser. No. 08/789,171, which was filed on Jan. 24, 1997, in the name of Trinh et al. Shrinkage reducing compositions for use in this invention can be found in co-pending U.S. Provisional Application No. 60/097,596, entitled "Cleaning Compositions that Reduce Fabric Shrinkage", which was filed by Strang and Siklosi, on Aug. 24, 1998.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention. All documents cited in the Detailed Description of the Invention are, in relevant part, incorporated herein by reference. The citation of any document is not to be construed as an admission that it is prior art with respect to the present invention.

What is claimed is:

1. An in-home method for treating a fabric article in need of treatment comprising:

a. providing a new to the world, in-home, self-contained, stand alone fabric article treating apparatus designed for domestic use, wherein the apparatus comprises 1) a housing which defines a fabric article receiving volume, 2) a fabric article fixturing system which immobilizes and tensions the fabric article, and 3) a source of an electrically charged liquid comprising water and a member selected from the group consisting of organic solvents, surfactants, wrinkle releasing agents, anti-static agents, soil release agents, colorants, brighteners, perfume and mixtures thereof, said liquid having an applied potential of from about 0.2 kV to about 50 kV: 4) a vent; and optionally, 5) a safety system capable of preventing contact of the electrically charged liquid to a user of the fabric article treating apparatus;

b. positioning the fabric article in need of treatment, said article comprising malodors, within the fabric article receiving volume by associating the fabric article with the fabric article fixturing system under tension to mechanically stretch the article;

c. operating the fabric article treating apparatus such that the source of the electrically charged liquid delivers the electrically charged liquid to the fabric article positioned within the fabric article receiving volume and drives deposition of the liquid onto the fabric article, such that the fabric article is cleaned, dewrinkled and/or deodorized by said treatment, wherein the electrically charged liquid being delivered to the fabric article is formed into droplets by electrostatic ligament atomization; and wherein d. steam is supplied to the article to remove said malodors therefrom by passage of said malodors out through said vent prior to the delivery of the electrically charged liquid in step (c); and e. drying the treated fabric article with warm air after application of the electrically charged liquid to the article, wherein the air used during the drying is at a temperature from about 50° C. to about 100° C.; and f. wherein said electrically charged liquid further comprises cyclodextrin and a fabric shrinkage reducing composition comprising neopentyl glycol.

* * * * *